US007980872B1

(12) United States Patent
Smutny et al.

(10) Patent No.: US 7,980,872 B1
(45) Date of Patent: Jul. 19, 2011

(54) SPLICE ASSEMBLY

(75) Inventors: Dale J. Smutny, Canfield, OH (US); Wesley W. Weber, Cortland, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 12/723,741

(22) Filed: Mar. 15, 2010

(51) Int. Cl.
*H01R 29/00* (2006.01)

(52) U.S. Cl. ..... 439/189; 439/790; 439/656

(58) Field of Classification Search ..... 439/189, 439/790, 725, 656, 596
See application file for complete search history.

(56) References Cited

U.S. PATENT DOCUMENTS 5,741,147 A * 4/1998 Konoya et al. ..... 439/189
6,645,003 B2 11/2003 Yoshida et al.
7,332,674 B2 2/2008 Peterson et al.
7,351,085 B2 * 4/2008 Tamagawa et al. ..... 439/189

* cited by examiner

*Primary Examiner* — Javaid Nasri
(74) *Attorney, Agent, or Firm* — Thomas N. Twomey

(57) ABSTRACT

An electrical splice assembly includes a conductive bus plate having a plurality of male blades, an insulative housing having a forward portion retaining the bus plate and a rearward portion defining a terminal receiving tray, a plurality of female terminals disposed in the terminal receiving tray and attached to the male blades, and a cover integrally hingedly attached to the housing. The cover includes a lock bar that projects into the terminal receiving tray to retain the terminals in connection with the bus plate when the cover is in a closed position overlying the tray. The housing further includes an intermediate portion defining a plurality of spaced longitudinally extending cavities in communication with a space defined by the tray. At least a portion of each blade and a portion of each terminal extend into respective cavities.

16 Claims, 3 Drawing Sheets

SPLICE ASSEMBLY

TECHNICAL FIELD OF INVENTION

The invention relates to electrical splice assemblies.

BACKGROUND OF INVENTION

Joint connectors are used, for example, in automotive splice applications in which a centralized connector is needed to connect one or more main cables to a plurality of branching cables. Such joint connectors typically comprise many component parts, such as a housing, terminals, bus bars, a cover, and the like. Consequently, such joint connectors may be complicated, expensive to manufacture, and bulky, making them difficult to package in some applications. A need remains, such as in vehicle electrical systems incorporating a decentralized splicing arrangement, for a reliable, low cost, light weight and compact electrical splice assembly.

SUMMARY OF THE INVENTION

The invention can aid in providing an electrical splice assembly that can include an insulative housing that in part defines a terminal receiving tray, a conductive bus plate retained in the housing, a plurality of conductive female terminals disposed in the terminal receiving tray and connected to the bus plate, and a cover moveably attached to the housing. The cover can include a terminal lock configured to retain the terminals in the tray when the cover is in a closed position overlying the tray.

The invention can also aid in providing an electrical splice assembly that can include a conductive bus plate, an insulative housing retaining the bus plate, and a cover integrally, hingedly attached to the housing. The housing can include a terminal receiving tray. The tray can include a floor extending between longitudinally extending side walls. In this situation, the floor and the side walls define a tray space. Also, in this situation, the housing further defines a plurality of spaced longitudinally extending cavities that communicate with the tray space and the bus plate includes a plurality of the spaced male blades. Each one of the blades is at least partially disposed in a respective one of the cavities. Furthermore, in this situation, the cover is movable to a closed position in which the cover overlies the terminal receiving tray.

In still another implementation of the invention, it is possible to provide an electrical splice assembly that includes an insulative housing, at least one conductive bus plate, a plurality of conductive female terminals, and a terminal lock bar integrally hingedly attached to the housing. In this arrangement, the housing includes a forward bus plate retainer and a rearward terminal receiving tray. The bus plate includes a strip and a plurality of cantilevered, coplanar, spaced male blades extending from the strip. The strip is disposed in the bus plate retainer. The terminals are disposed in the tray and connected to the blades, respectively. Also, in this arrangement, the lock bar has a locked position in which the lock bar prevents each one of the terminals from backing out of the tray.

The invention can enable splice assembly embodiments that have a small mass, embodiments that include a housing and integrally attached hinged cover that can be manufactured with inexpensive tooling, and embodiments that include a housing having terminal cavities defined by smooth cavity walls—free of terminal retention features—that enable terminals of various designs to be received in the cavities.

The invention can be implemented in single circuit and multiple circuit splice assembly embodiments. The invention further can be implemented in splice assembly embodiments that can function without the need for the housing cavities to be fully populated. The invention can further be implemented in splice assembly embodiments that are suitable for application in vehicles.

Further features, uses and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
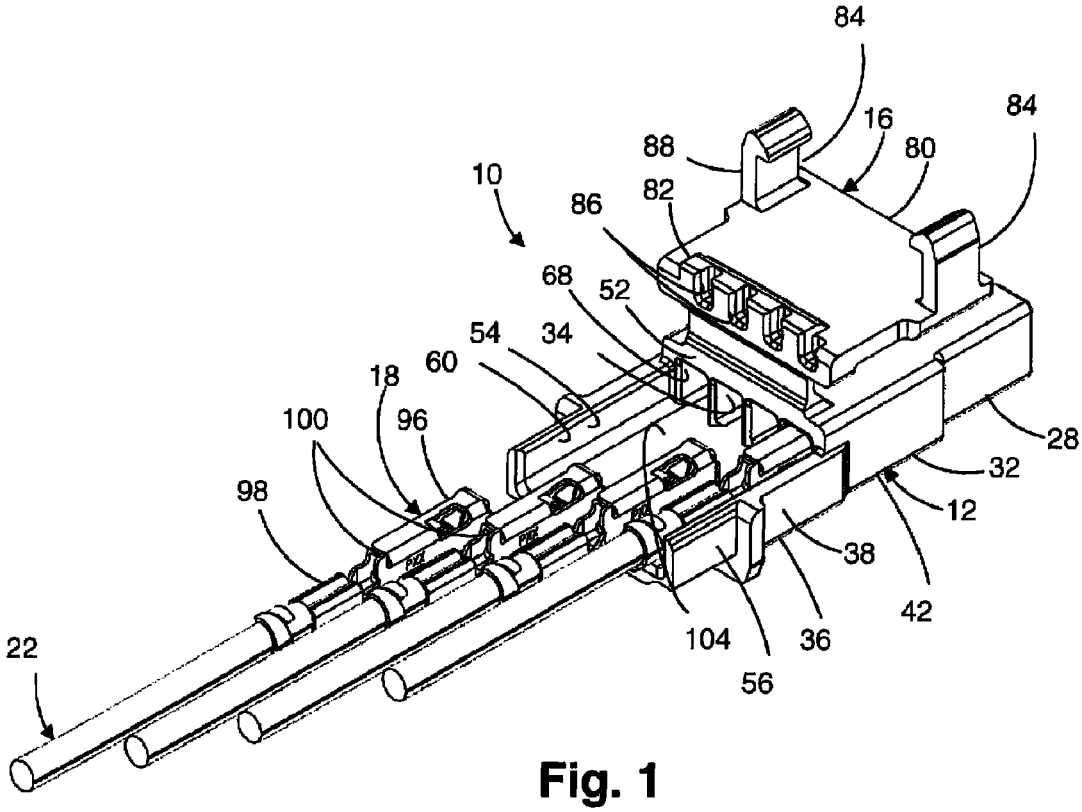
FIG. 1 is a partially exploded perspective view of an electrical splice assembly in accordance with an embodiment of the present invention.

Referring to the figures, an electrical splice assembly 10 in accordance with a preferred embodiment of the present invention includes an insulative housing 12, at least one generally planar conductive bus plate 14, a cover 16 integrally attached to the housing 12, and a plurality of female terminals 18 that are attached to respective exposed ends 20 of insulated electric cables 22.

Bus plate 14 (two shown in FIG. 2) includes a forward elongated strip 24 and a plurality of cantilevered, coplanar, spaced male blades 26 that extend perpendicular to and rearward from the strip 24.

Figure 3:
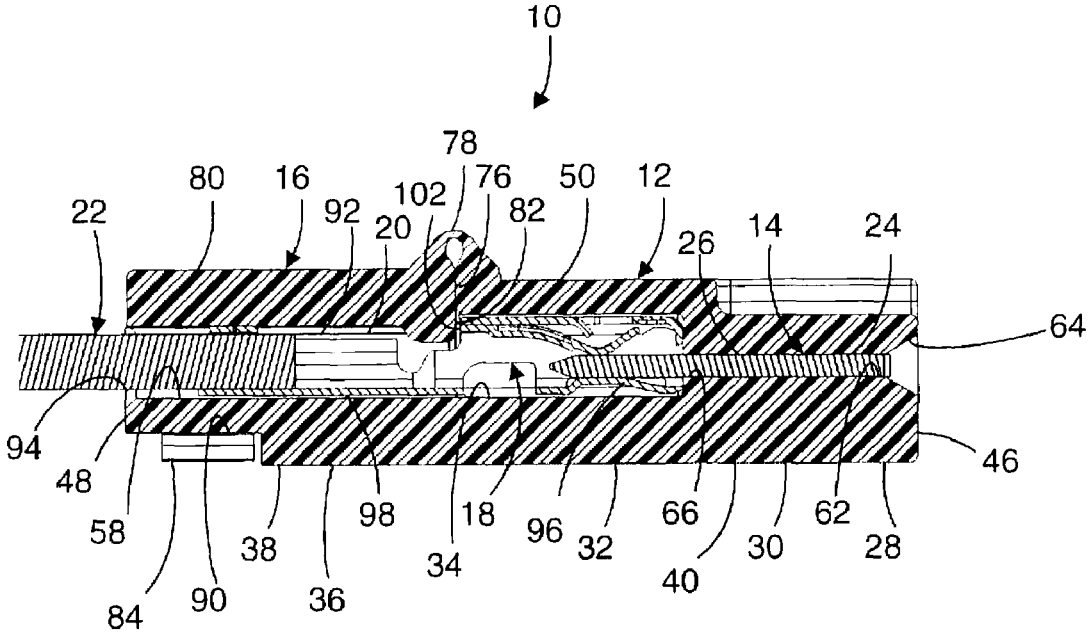
FIG. 3 is a side longitudinal section view of an electrical splice assembly in accordance with an embodiment of the present invention.
Figure 4:
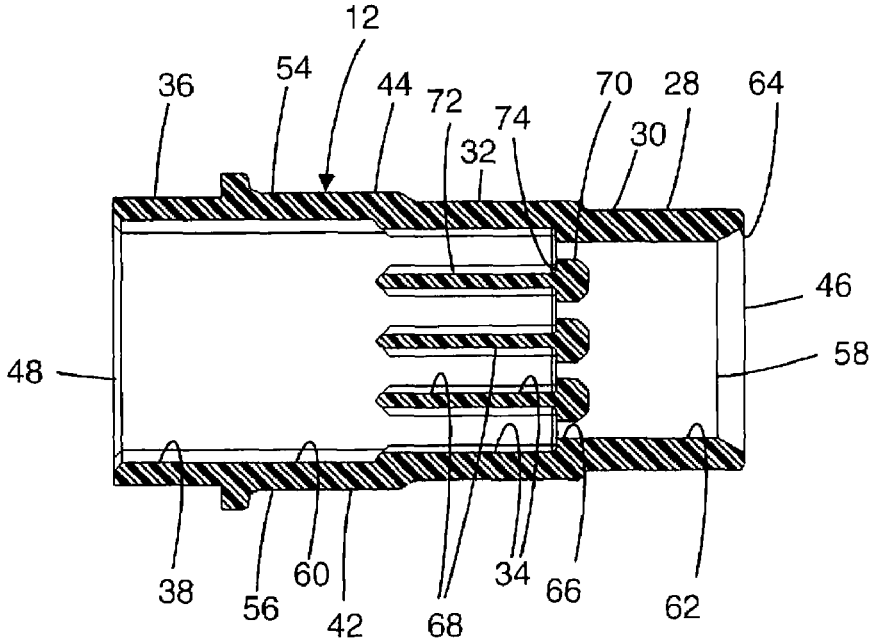
FIG. 4 is a top longitudinal section view of an electrical splice assembly in accordance with an embodiment of the present invention.

With reference primarily to FIGS. 3 and 4, the housing 12 includes a forward portion 28 defining a bus plate retainer 30, an intermediate portion 32 defining a plurality of longitudinally extending cavities 34, and a rearward portion 36 defining a terminal receiving tray 38. The housing 12 is defined in part by a rigid housing floor 40 and rigid housing side walls 42, 44 that extend between a front face 46 and a rear face 48 of the housing 12. The housing 12 is further defined by a rigid housing ceiling 50 that extends from the front face 46 to a rearward end 52 of the intermediate portion 32.

The terminal receiving tray 38 includes tray side wall 54, 56 portions of the housing side walls 42, 44 and a tray floor 58 portion of the housing floor 40. The tray floor 58 extends between the tray side walls 54, 56. As best shown in FIG. 1, tray floor 58 and tray side walls 54, 56 define a tray space 60.

Primarily referring once again to FIGS. 3 and 4, the bus plate retainer 30 defines a forward slot 62 having an opening 64 in the front face 46. The opening 64 is configured to enable insertion of the bus plate 14 into the forward slot 62. A plurality of spaced blade receiving passages 66 extend longitudinally rearward from the forward slot 62 into respective cavities 34. Longitudinally extending interior passage walls 70 of the bus plate retainer 30 electrically isolate each of the passages 66 from each other.

Each of the cavities 34 extend longitudinally rearward from respective blade receiving passages 66 to the tray space 60. Longitudinally extending interior cavity walls 72 of the intermediate portion 32 electrically isolate each of the cavities 34 from each other. Each of the cavities 34 are defined by longitudinally extending interior surfaces 68 that are smooth and free of terminal retention features. The bus plate retainer 30 provides internal forward stop shoulders 74 for the female terminals 18. Alternatively, the female terminals 18 may also stop against the bus plate 14.

Figure 2:
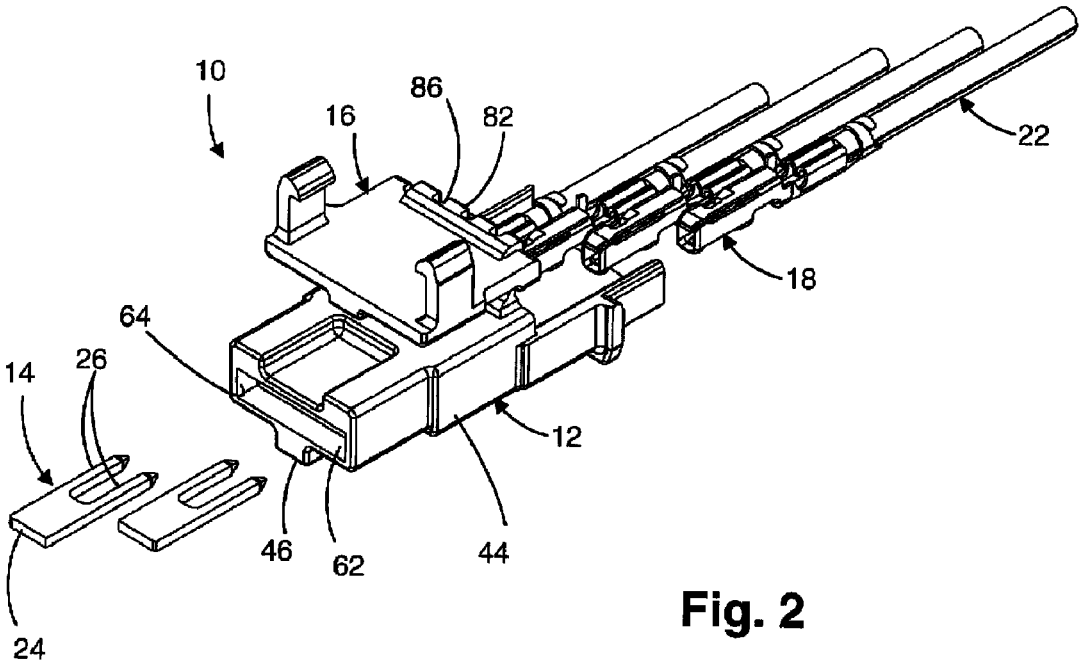
FIG. 2 is another partially exploded perspective view of an electrical splice assembly in accordance with an embodiment of the present invention.

With reference primarily to FIGS. 1-3 and FIG. 5, moveable cover 16 is integrally attached to a rearward end 76 of the housing ceiling 50 by a flexible hinge 78. The cover 16 has a closed position (as shown in FIG. 3) in which the cover 16 overlies the terminal receiving tray 38. The cover 16 is moveable between the closed position and a fully open position (as shown in FIGS. 1 and 2) in which the cover 16 is bent back toward the front face 46 of the housing about 180 degrees from the closed position. The cover 16 includes a lid 80, a laterally extending terminal lock bar 82 in the shape of a rail that extends from the lid 80, and two latches 84 that extend from opposite sides of the lid 80. As best shown in FIGS. 3 and 6, the terminal lock bar 82 is configured to project into the terminal receiving tray 38 when the cover 16 is in the closed position. As best shown in FIGS. 1, 2, and 6, a plurality of spaced index slots 86 are formed in the terminal lock bar 82. Referring primarily now to FIGS. 1 and 3, each of the two latches 84 include an arm 88 and a latching surface 90 that engages the housing floor 40 when the cover 16 is in the closed position to releasably retain the cover 16 in the closed position. As best shown in FIG. 3, the housing 12 and closed cover 16 together substantially enclose the terminals 18 and exposed conductor 92 of the stripped end 20 of the cables 22. An open rearward end 94 provides sufficient space for the insulated cables 22 to extend rearward out of the tray space 60 when the cover 16 is in the closed position.

Referring now to FIGS. 1 and 3, each one of the plurality of female terminals 18 has a box shaped forward distal portion 96 and a rearward crimp section 98. An indexing tab 100 extends from the box shaped forward portion 96. The box shaped forward portion 96 includes a rearward facing lock shoulder 102.

Figure 5:
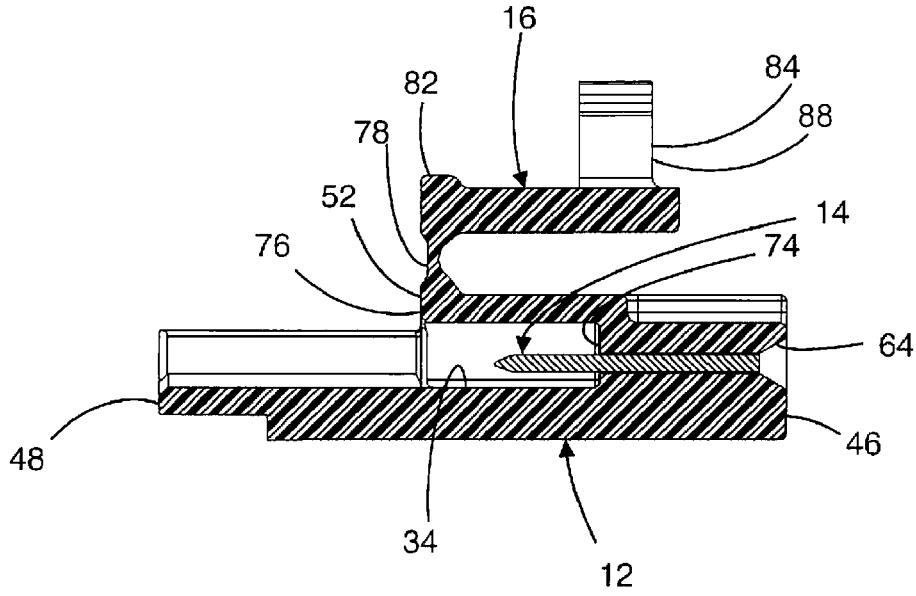
FIG. 5 is a longitudinal section view of an electrical splice assembly in accordance with an embodiment of the present invention.
Figure 6:
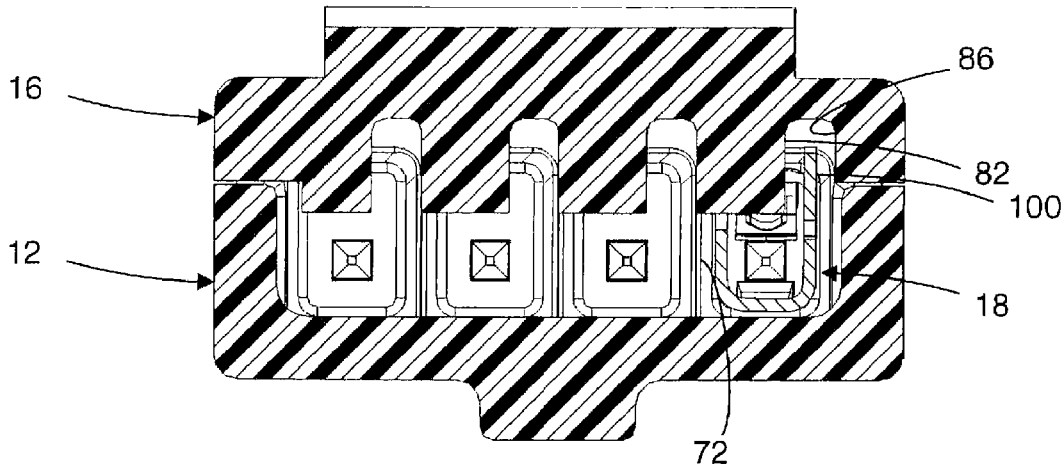
FIG. 6 is a cross sectional view of an electrical splice assembly in accordance with an embodiment of the present invention.

Referring primarily now to FIGS. 3 and 5, at least one bus plate 14 is retained in the housing 12. The strip 24 is disposed in the slot 62 and each one of the plurality of blades 26 extend rearward from the strip 24 through a respective one of the blade receiving passages 66 into a respective one of the cavities 34. The forward box shaped portion 96 of each one of the plurality of female terminals 18 is received in a respective one of the cavities 34 and is electrically connected to a respective one of the plurality of blades 26. The rearward crimp section 98 of each one of the plurality of female terminals 18 is received in the tray space 60. Terminal lock bar 82 prevents each one of the terminals 18 from backing out of the tray 38 and retains the terminals 18 in connection with bus plate 14 by abutting against lock shoulder 102 when a rearward directed force is applied to the terminals 18. As best shown in FIG. 6, the tab 100 on each one of the terminals 18 mates with a respective one of the index slots 86 assuring that each one of the terminals 18 is properly oriented within the housing 12.

The electrical splice assembly 10 is generally made in the following manner. Housing 12 and cover 16 are preferably composed of polypropylene or other suitable electrically insulative material and integrally formed together by an injection molding process. Bus plate 14 is assembled to the housing 12 by inserting the bus plate 12 into the forward slot 62 via the forward opening 64. The bus plate 14 is retained in the housing 12 by a press fit. Alternately, housing 12, cover 16, and bus plate 14 may be formed together by an insert molding process.

Preferably, the housing 12 and the cover 16 are initially formed together so that the cover 16 is in an open position providing sufficient space for each one of the plurality of female terminals 18 to be fully inserted into the terminal receiving tray 38 via a top opening 104 in the terminal receiving tray 38 and the rearward open end 94. When the terminals 18 are fully inserted in the terminal receiving tray 38 the forward box shaped portion 96 of each one of the terminals 18 extends into a respective one of the cavities 34 and electrically connects to a respective one of the blades 26 and the rearward crimp portion 98 of each one of the terminals 18 is disposed in the tray space 60. Once the terminals 18 are connected to the blades 26 they are temporarily held in place by a retention force between the terminals 18 and the blades 26. After all of the terminals 18 are fully inserted in the housing 12, the cover 16 is then moved from the open position to the closed position overlying the tray 38 and the two latches 84 are engaged to the underside of the tray floor 58 releasably retaining the cover 16 in the closed position.

As shown in FIG. 2, the electrical splice assembly 10 may include two or more bus plates 14 that are electrically isolated from each other. The cavities 34 may be fully populated with female terminals 18. Alternatively, the electrical splice assembly 10 will function with one or more cavities 34 empty.

While this invention has been described in terms of the preferred embodiments thereof, it is not intended to be so limited, but rather only to the extent set forth in the claims that follow.

We claim:

1. An electrical splice assembly comprising:

an insulative housing comprising a terminal receiving tray, the terminal receiving tray comprising a floor and longitudinally extending side walls of the housing, the floor extending between the side walls, the floor and the side walls defining a tray space, the tray having an open top that extends to an open rearward end of the tray in a rear face of the housing, the housing further defining a plurality of longitudinally extending cavities communicating with the tray space;

a conductive bus plate retained in a forward portion of the housing, the bus plate comprising a strip and a plurality of cantilevered, coplanar, spaced male blades extending from the strip, each one of the plurality of male blades extending into a respective one of the plurality of cavities;

a plurality of conductive female terminals disposed in the terminal receiving tray, a forward portion of each one of the plurality of terminals extends into a respective one of the cavities and is connected to a respective one of the blades of the bus plate; and a cover movably attached to the housing, wherein the cover includes a lock configured to retain the terminals in the terminal receiving tray when the cover is in a closed position overlying the tray.

2. The electrical splice assembly of claim 1, wherein the cover is integrally attached to the housing by at least one hinge.

3. The electrical splice assembly of claim 2, wherein the cover is movable to an open position exposing the open top, the open top providing an opening adapted and configured to provide sufficient space for the plurality of terminals to be inserted into the terminal receiving tray during a terminal insertion process.

4. The electrical splice assembly of claim 3, wherein the cover comprises a latch configured to engage the housing to retain the cover in the closed position.

5. The electrical splice assembly of claim 1, wherein the lock comprises a laterally extending lock bar that extends into the tray space when the cover is in the closed position for retaining the terminals in the terminal receiving tray.

6. The electrical splice assembly of claim 5, wherein the lock bar defines a plurality of indexing slots configured to mate with a tab disposed on each one of the plurality of terminals, respectively.

7. The electrical splice assembly of claim 1, wherein the plurality of cavities is defined by a plurality of smooth longitudinally extending interior surfaces of the housing that are free of features that retain the female electrical terminals in the cavities.

8. An electrical splice assembly comprising:

a conductive bus plate, an insulative housing retaining the bus plate, and a cover integrally hingedly attached to the housing;

the housing comprising a forward bus plate retainer, an intermediate portion defining a plurality of spaced longitudinally extending cavities, and a rearward terminal receiving tray, the tray comprising a floor and longitudinally extending side walls, the floor extending between the side walls, the floor and the side walls defining a tray space communicating with the plurality of cavities, the tray having an open top that extends to an open rearward end of the tray in a rear face of the housing;

the bus plate comprising a strip and a plurality of cantilevered spaced male blades extending from the strip, each one of the plurality of blades being at least partially disposed in a respective one of the plurality of cavities;

the cover movable to a closed position in which the cover overlies the terminal receiving tray.

9. The electrical splice assembly of claim 8, wherein the bus plate retainer defines a longitudinally extending slot having an opening in a front face of the housing, each of the plurality of cavities being in communication with the slot, the housing retaining the strip in the slot in a press-fit manner whereby each one of the plurality of blades extends from the strip into a respective one of the plurality of cavities.

10. The electrical splice assembly of claim 9, wherein the housing further defines a plurality of longitudinally extending blade passages, each one of the plurality of blade passages extends between the slot and a respective one of the plurality of cavities, wherein the plurality of blades extend from the strip through the blade passages into the cavities, respectively.

11. The electrical splice assembly of claim 8, wherein the cover comprises a lateral terminal lock bar, wherein the cover being in the closed position the lock bar projects into the tray space.

12. The electrical splice assembly of claim 11, wherein each of the cavities are defined by smooth longitudinally extending interior walls of the housing.

13. The electrical splice assembly of claim 11, further comprises a plurality of conductive female terminals attached to wires, the plurality of terminals being attached to the plurality of spaced male blades, respectively, a forward portion of each one of the plurality of terminals being disposed in a respective one of the plurality of cavities and a rearward portion of each one of the plurality of terminals being disposed in the tray space, wherein the lock bar retains each one of the plurality of terminals in its respective cavity.

14. The electrical splice assembly of claim 8, wherein the bus plate is insert molded into the housing.

15. An electrical splice assembly comprising:

an insulative housing comprising a forward bus plate retainer, a rearward terminal receiving tray, and a plurality of parallel terminal receiving cavities that extend between the bus plate retainer and the terminal receiving tray;

at least one conductive bus plate, the bus plate comprising a strip and a plurality of cantilevered, coplanar, spaced male blades extending from the strip, the strip being disposed in the bus plate retainer;

a plurality of conductive female terminals being disposed in the terminal receiving tray and extending into the terminal receiving cavities, each one of the plurality of terminals being connected to a respective one of the plurality of spaced male blades; and a terminal lock bar integrally hingedly attached to the housing, the terminal lock bar having a locked position in which the lock bar prevents each one of the plurality of terminals from backing out of the terminal receiving tray, wherein the plurality of cavities is defined by a plurality of smooth longitudinally extending interior surfaces of the housing that are free of features that retain the female electrical terminals in the cavities.

16. The electrical splice assembly of claim 15, further comprising a cover that overlies the terminal receiving tray when the terminal lock bar is in the locked position, wherein the terminal lock bar is a laterally extending rail formed in the cover.

* * * * *